US005866748A

United States Patent [19]

Wittenbrink et al.

[11] Patent Number: 5,866,748

[45] Date of Patent: Feb. 2, 1999

[54] HYDROISOMERIZATION OF A PREDOMINANTLY N-PARAFFIN FEED TO PRODUCE HIGH PURITY SOLVENT COMPOSITIONS

[75] Inventors: Robert Jay Wittenbrink; Daniel Francis Ryan, both of Baton Rouge, La.; Steven Earl Silverberg, Seabrook, Tex.

[73] Assignee: Exxon Research and Engineering Company, Florham Park, N.J.

[21] Appl. No.: 636,424

[22] Filed: Apr. 23, 1996

[51] Int. Cl.[6] ..... C10C 5/13

[52] U.S. Cl. ..... 585/734; 585/739; 208/138; 208/950; 208/112

[58] Field of Search ..... 208/58, 950, 138, 208/112; 585/734, 739

[56] References Cited

U.S. PATENT DOCUMENTS

| | | | |
|---|---|---|---|
| 2,888,501 | 5/1959 | Folkins et al. | 585/751 |
| 2,892,003 | 6/1959 | Weisz | 585/751 |
| 2,982,802 | 5/1961 | Folkins et al. | 585/751 |
| 3,709,817 | 1/1973 | Suggitt et al. | 208/112 |
| 3,848,018 | 11/1974 | Robson | 585/751 |
| 4,764,266 | 8/1988 | Chen et al. | 208/58 |
| 4,851,109 | 7/1989 | Chen et al. | 208/58 |
| 4,855,530 | 8/1989 | LaPierre et al. | 585/739 |
| 4,911,821 | 3/1990 | Katzer et al. | 208/27 |
| 4,919,788 | 4/1990 | Chen et al. | 208/59 |
| 5,292,988 | 3/1994 | Wu | 585/751 |
| 5,292,989 | 3/1994 | Davis | 585/751 |

*Primary Examiner*—Helane Myers
*Attorney, Agent, or Firm*—Jay Simon

[57] ABSTRACT

A process for the hydroisomerization of a predominantly $C_8$–$C_{20}$ n-paraffinic feed to produce a high purity $C_8$ –$C_{20}$ paraffinic solvent composition having superior low temperature properties, and low viscosities. The feed is contacted, with hydrogen, over a dual functional catalyst to hydroisomerize and convert the feed to a product comprising a mixture of n-paraffins and isoparaffins, the isoparaffins component of which contains greater than 50 percent of monomethyl species, with the molar ratio of isoparaffins:n-paraffins ranging from about 0.5:1 to 9:1.

19 Claims, No Drawings

HYDROISOMERIZATION OF A PREDOMINANTLY N-PARAFFIN FEED TO PRODUCE HIGH PURITY SOLVENT COMPOSITIONS

1. Field of the Invention

This invention relates to a hydroisomerization process for the production, from paraffin feeds, of high purity paraffinic solvent compositions characterized as mixtures of $C_8$–$C_{20}$ n-paraffins and isoparaffins, with the isoparaffins containing predominantly methyl branching and an isoparaffin:n-paraffin ratio sufficient to provide products having superior low temperature properties and low viscosities.

2. Background

Paraffinic solvents provide a variety of industrial uses. For example, NORPAR solvents, several grades of which are marketed by Exxon Chemical Company, e.g., are constituted almost entirely of $C_{10}$–$C_{15}$ linear, or normal paraffins (n-paraffins). They are made by the molecular sieve extraction of kerosene via the ENSORB process. These solvents, because of their high selective solvency, low reactivity, mild odor and relatively low viscosity, are used in aluminum rolling oils, as diluent solvents in carbonless copy paper, and in spark erosion machinery. They are used successfully in pesticides, both in emulsifiable concentrates and in formulations to be applied by controlled droplet application, and can even meet certain FDA requirements for use in food-related applications. The NORPAR solvents, while having relatively low viscosity, unfortunately have relatively high pour points; properties which cannot be improved in the ENSORB process by a wider n-paraffin cut because the $C_{15}$+n-paraffins have low melting points. Thus, the addition of $C_{15}$+paraffins will only worsen the pour point.

Three typical grades of NORPAR solvents are NORPAR 12, NORPAR 13, and NORPAR 15; the numerals 12, 13, and 15 respectively, designating the average carbon number of the paraffins contained in the paraffinic mixture. Solvents with an average carbon number of 14 rarely meets the specifications of the specialty solvent market, and consequently such solvents are generally downgraded and sold as fuel. The NORPAR 15 solvent, while it generally meets the specifications of the specialty solvent market, has a relatively high melting point and must be stored in heated tanks.

Solvents constituted of mixtures of highly branched paraffins, or isoparaffins, with very low n-paraffin content, are also commercially available. For example, several grades of ISOPAR solvents, i.e., isoparaffins or highly branched paraffins, are supplied by Exxon Chemical Company. These solvents, derived from alkylate bottoms (typically prepared by alkylation), have many good properties; e.g., high purity, low odor, good oxidation stability, low pour point, and are suitable for many food-related uses. Moreover, they possess excellent low temperature properties. Unfortunately however, the ISOPAR solvents have high viscosities, e.g., as contrasted with the NORPAR solvents. Despite the need, a solvent which possesses substantially the desirable properties of both the NORPAR and ISOPAR solvents, but particularly the low viscosity of the NORPAR solvents and the low temperature properties of the ISOPAR solvents is not available.

3. the Invention

The present invention, to meet these and other needs, relates to a process which comprises contacting and reacting, with hydrogen, a feed characterized as a mixture of paraffins, predominantly n-paraffins, having from about 8 to about 20 carbon atoms per molecule, i.e., about $C_8$–$C_{20}$, preferably about $C_{10}$–$C_{16}$, over a dual function catalyst at conditions sufficient to hydroisomerize and convert the feed to a mixture of isoparaffins of substantially the same carbon number, i.e., $C_8$–$C_{20}$, or $C_{10}$–$C_{16}$, which contain greater than fifty percent, 50%, mono-methyl species, e.g., 2-methyl, 3-methyl, 4-methyl, ≧5-methyl or the like, with minimum formation of branches with substituent groups of carbon number greater than 1, i.e., ethyl, propyl, butyl or the like, based on the total weight of isoparaffins in the mixture. Preferably, the isoparaffins of the product mixture contain greater than 70 percent of the mono-methyl species, based on the total weight of the isoparaffins in the mixture. The product solvent composition has an isoparaffin:n-paraffin ratio ranging from about 0.5:1 to about 9:1, preferably from about 1:1 to about 4:1. The product solvent composition boils within a range of from about 320° F. to about 650° F., and preferably within a range of from about 350° F. to about 550° F. To prepare different solvent grades, the paraffinic solvent mixture is generally fractionated into cuts having narrow boiling ranges, i.e., 100° F., or 50° F. boiling ranges.

In the ensuing hydroisomerization reaction a major concentration of the paraffinic feed is thus converted into isoparaffins which contain one or more methyl branches, with little or no cracking of the molecules. The carbon number distribution of the molecular constituents of the product is essentially the same as that of the feed. A feed constituted of an essentially $C_8$–$C_{20}$ paraffinic mixture of n-paraffins will produce a product rich in $C_8$–$C_{20}$ isoparaffins which contain greater than 50 percent mono-methyl paraffins, and preferably greater than 70 percent mono-methyl paraffins, based on the weight of the product. A feed constituted of an essentially $C_{10}$–$C_{16}$ paraffinic mixture of n-paraffins will produce a product constituted essentially of a $C_{10}$–$C_{16}$ paraffinic mixture of isoparaffins which contains greater than 50 percent mono-methyl paraffins, and preferably greater than 70 percent mono-methyl paraffins, based on the weight of the product. The solvent product has an isoparaffin:n-paraffin ratio ranging from about 0.5:1 to about 9:1, preferably about 1:1 to about 4:1, and boils within a range of from about 320° F. to about 650° F., preferably from about 350° F. to about 550° F.

The properties of these solvents e.g., viscosity, solvency and density, are similar to NORPAR solvents of similar volatility but have significantly improved low temperature properties (e.g., lower pour or lower freeze points). These solvents also have significantly lower viscosities than ISOPAR solvents of similar volatility. In fact, these solvents combine many of the most desirable properties found in the NORPAR and ISOPAR solvents. The solvents made by the process of this invention have the good low temperature properties of ISOPAR solvents and the low viscosities of the NORPAR solvent; and yet maintain most of the other important properties of these solvents.

The $C_8$–$C_{20}$ paraffinic feed, or $C_{10}$–$C_{16}$ paraffinic feed, is preferably one obtained from a Fischer-Tropsch process; a process known to produce substantially n-paraffins having negligible amounts of aromatics, sulfur and nitrogen compounds. The Fischer-Tropsch liquid, and wax, is characterized as the product of a Fischer-Tropsch process wherein a synthetic gas, or mixture of hydrogen and carbon monoxide, is processed at elevated temperature over a supported catalyst comprised of a Group VIII metal, or metals, of the Periodic Table Of The Elements (Sargent-Welch Scientific Company, Copyright 1968), e.g., cobalt, ruthenium, iron, etc., especially cobalt which is preferred. A distillation showing the fractional make up (±10 wt. % for each fraction) of a typical Fischer-Tropsch reaction product is as follows:

| Boiling Temperature Range | Wt. % of Fraction |
|---|---|
| IBP–320° F. | 13 |
| 320–5000° F. | 23 |
| 500–700° F. | 19 |
| 700–1050° F. | 34 |
| 1050° F.+ | 11 |
| | 100 |

The NORPAR solvents, which are predominantly n-paraffins, can be used as feeds and upgraded to solvents having lower pour points. A solvent with an average carbon number of 14 is, e.g., a suitable and preferred feed, and can be readily upgraded to solvents having considerably lower pour points, without loss of other important properties.

The paraffinic feed is contacted, with hydrogen, at hydroisomerization conditions over a bifunctional catalyst, or catalyst containing a metal, or metals, hydrogenation component and an acidic oxide support component active in producing hydroisomerization reactions. Preferably, a fixed bed of the catalyst is contacted with the feed at temperature ranging from about 400° F. to about 850° F., preferably from about 550° F. to about 700° F., and at pressures ranging generally from about 100 pounds per square inch gauge (psig) to about 1500 psig, preferably from about 250 psig to about 1000 psig sufficient to hydroisomerize, but avoid cracking, the feed. Hydrogen treat gas rates range from about 1000 SCFB to about 10,000 SCFB, preferably from about 2000 SCFB to about 5000 SCFB, with negligible hydrogen consumption. Space velocities range generally from about 0.5 W/Hr/W to about 10 W/Hr/W, preferably from about 1.0 W/Hr/W to about 5.0 W/Hr/W.

The active metal component of the catalyst is preferably a Group VIII metal, or metals, of the Periodic Table Of The Elements (Sargent-Welch Scientific Company Copyright 1968), suitably in sulfided form, in amount sufficient to be catalytically active for dehydrogenation of the paraffinic feed. The catalyst may also contain, in addition to the Group VIII metal, or metals, a Group IB and/or a Group VIB metal, or metals, of the Periodic Table. Generally, metal concentrations range from about 0.05 percent to about 20 percent, based on the total weight of the catalyst (wt. %), preferably from about 0.1 wt. percent to about 10 wt. percent. Exemplary of such metals are such non-noble Group VIII metals as nickel and cobalt, or mixtures of these metals with each other or with other metals, such as copper, a Group IB metal, or molybdenum, a Group VIII metal. Palladium and platinum are exemplary of suitable Group VIII noble metals. The metal, or metals, is incorporated with the support component of the catalyst by known methods, e.g., by impregnation of the support with a solution of a suitable salt or acid of the metal, or metals, drying and calcination.

The catalyst support is constituted of metal oxide, or metal oxides, components at least one component of which is an acidic oxide active in producing olefin cracking and hydroisomerization reactions. Exemplary oxides include silica, silica-alumina, clays, e.g., pillared clays, magnesia, titania, zirconia, halides, e.g., chlorided alumina, and the like. The catalyst support is preferably constituted of silica and alumina, a particularly preferred support being constituted of up to about 35 wt. % silica, preferably from about 2 wt. % to about 35 wt. % silica, and having the following pore-structural characteristics:

| Pore Radius, Å | Pore Volume |
|---|---|
| 0–300 | >0.03 ml/g |
| 100–75,000 | <0.35 ml/g |
| 0–30 | <25% of the volume of the pores with 0–300 Å radius |
| 100–300 | <40% of the volume of the pores with 0–300 Å radius |

The base silica and alumina materials can be, e.g., soluble silica containing compounds such as alkali metal silicates (preferably where $Na_2O:SiO_2$=1:2 to 1:4), tetraalkoxy silane, orthosilic acid ester, etc.; sulfates, nitrates, or chlorides of aluminum alkali metal aluminates; or inorganic or organic salts of alkoxides or the like. When precipitating the hydrates of silica or alumina from a solution of such starting materials, a suitable acid or base is added and the pH is set within a range of about 6.0 to 11.0. Precipitation and aging are carried out, with heating, by adding an acid or base under reflux to prevent evaporation of the treating liquid and change of pH. The remainder of the support producing process is the same as those commonly employed, including filtering, drying and calcination of the support material. The support may also contain small amounts, e.g., 1–30 wt. %, of materials such as magnesia, titania, zirconia, hafnia, or the like.

Support materials and their preparation are described more fully in U.S. Pat. No. 3,843,509 incorporated herein by reference. The support materials generally have a surface area ranging from about 180–400 $m^2/g$, preferably 230–375 $m^2/g$, a pore volume generally of about 0.3 to 1.0 ml/g, preferably about 0.5 to 0.95 ml/g, bulk density of generally about 0.5–1.0 g/ml, and a side crushing strength of about 0.8 to 3.5 kg/mm.

The hydroisomerization reaction is conducted in one or a plurality of reactors connected in series, generally from about 1 to about 5 reactors; but preferably the reaction is conducted in a single reactor. The paraffinic feed is fed, with hydrogen, into the reactor, or first reactor of a series, to contact a fixed bed of the catalyst at hydroisomerization reaction conditions sufficient to hydroisomerize and convert at least a portion of the feed to products suitable as high purity paraffinic solvent compositions, as previously described.

If desired, the hydroisomerized product can be hydrotreated to remove trace amounts of impurities, if any, olefins, etc. This type of treatment may be sometimes desirable to render the product suitable to meet FDA specifications, or the like.

The following exemplifies the more salient features of the invention. All parts, and percentages, are given in terms of weight unless otherwise specified.

EXAMPLE

A vaporous feed containing 87.7 wt. % $nC_{14}$ was passed, with hydrogen at 1800 SCF/B into a reactor and hydroisomerized over a fixed bed of a Pd catalyst (0.3 wt. % Pd on an amorphous silica-alumina support consisting of about 20 wt. % bulk $SiO_2$+80 wt. % $Al_2O_3$), with minimal cracking of the feed, to produce a product having substantially the same carbon number distribution as the feed, but with considerably lower viscosities, and better low temperature properties than that of the feed. The carbon distribution numbers (C-No.) of the feed are given as follows:

| | |
|---|---|
| $nC_{12}$ | 0.045 wt. % |
| $nC_{13}$ | 4.444 wt. % |
| $nC_{14}$ | 87.697 wt. % |
| $nC_{15}$ | 7.639 wt. % |
| $nC_{16}$ | 0.175 wt. % |

The reaction was conducted with gradual increase of the space velocity of the entering feed, and temperature, to produce liquid products having the freeze points, and $C_{12}$+ yields given below:

| Space Velocity V/H/V | Temp, °F. | % $nC_{14}$ In Product | Freeze Point, °C. | $C_{12}$+ Yield wt. % on Feed |
|---|---|---|---|---|
| 34.3 | 636 | 51.5 | −4 | 99.1 |
| 34.8 | 646 | 39.1 | −6.5 | 98.2 |
| 35.0 | 656 | 28.1 | −11.5 | 96.6 |
| 37.1 | 666 | 21.1 | 155 | 92.1 |
| 34.0 | 667 | 15.6 | 20 | 89.3 |
| 40.2 | 677 | 12.3 | −23.5 | 87.0 |

A complete yield workup of the liquid product obtained at a freeze point of −20° C. is given in Table 1A.

TABLE 1A

YIELD WORKUP

| | | C-No | Feed, wt % n-par | TLP, wt. % n-par |
|---|---|---|---|---|
| | | 1 | | 0.002 |
| | | 2 | | 0.012 |
| Conditions | 34 | 3 | | 0.234 |
| V/H/V | | 4 | | 0.433 |
| | | 5 | | 0.373 |
| Temp., F. | 667 | 6 | | 0.505 |
| Psig | 400 | 7 | | 0.496 |
| $H_2$ Treat, SCF/B | 1800 | 8 | | 0.461 |
| | | 9 | | 0.420 |
| | | 10 | | 0.335 |
| $H_2$ Uptake, SCF/B | 70 | 11 | | 0.110 |
| | | 12 | 0.045 | 0.057 |
| TLP Freeze, C. | −20 | 13 | 4.444 | 4.951[1] |
| | | 14 | 87.697 | 15.366 |
| | | 15 | 7.639 | 0.755 |
| | | 16 | 0.175 | 0.010 |
| | | Sum | 100 | 24.520 |

| TLP 15/5 Distillation | wt. % | Yield, wt. % FF | |
|---|---|---|---|
| i-320 F. | 5.79 | | |
| 320/425 F. | 2.43 | C4-minus | 1.123 |
| 425/460 F. | 15.17 | C5/320 F. | 5.947 |
| 460 F.+ | 76.61 | 320/425 F. | 2.400 |
| Total | 100 | 425/460 F. | 14.987 |
| | | 460 F.+ | 75.680 |
| | | Total | 100.137 |

[1]n-$C_{13}$ G.C. peak contains some i-$C_{14}$ overlap

A workup of the product fractions obtained from the 15/5 distillation described above is given in Table 1B.

TABLE 1B

PRODUCT FRACTIONS

| | i–320 F. nor | other | 320–425 F. nor | other | 425–460 F. nor | other | 460 F.+ nor | other |
|---|---|---|---|---|---|---|---|---|
| C-No. | | | | | | | | |
| 4 | 1.086 | 0.923 | 0.114 | 0.185 | 0.013 | 0.027 | | |
| 5 | 4.420 | 5.435 | 0.105 | 0.218 | 0.005 | 0.011 | | |
| 6 | 6.660 | 9.014 | 0.096 | 0.135 | 0.002 | 0.004 | | |
| 7 | 6.659 | 13.384 | 0.322 | 0.429 | 0.009 | 0.009 | | |
| 8 | 5.761 | 16.794 | 1.437 | 2.816 | 0.071 | 0.116 | | |
| 9 | 3.898 | 16.405 | 3.526 | 9.263 | 0.288 | 0.665 | | |
| 10 | 0.807 | 8.297 | 6.288 | 22.410 | 0.659 | 2.150 | | 0.007 |
| 11 | 0.004 | 0.446 | 1.696 | 14.741 | 0.368 | 2.017 | | 0.028 |
| 12 | | 0.007 | 0.955 | 8.587 | 0.877 | 4.037 | 0.086 | 0.171 |
| 13 | | | 0.547 | 18.258 | 4.574 | 32.690 | 2.804 | 8.622 |
| 14 | | | 0.035 | 7.837 | 1.462 | 49.930 | 20.543 | 61.789 |
| 15 | | | | | | 0.016 | 1.079 | 4.768 |
| 16 | | | | | | | 0.013 | 0.090 |
| Total | 29.295 | 70.705 | 15.121 | 84.879 | 8.328 | 91.672 | 24.525 | 75.475 |
| Freeze, C. | | | | | | | | |
| Pred | | | | −68 | −45 | | | |
| Meas | | | | | | | −12.5 | |
| Br Index | | | | | | | 40 | |
| cST @ 100 C. | | | | | | | 0.901 | |
| AP1 | | | | | | | 52.5 | |
| Flash, F. | | | | | | | 225 | |
| D-93 | | | | | | | | |

It is apparent that various minor modifications and changes can be made without departing the spirit and scope of the invention.

Having described the invention what is claimed is:

1. A process for the production of high purity paraffinic solvent compositions having superior low temperature properties and low viscosities which comprises contacting in a reaction zone a feed constituted predominantly of n-paraffins of carbon number ranging from about $C_8$ to about $C_{20}$, with hydrogen, over a dual function catalyst comprised of a metal component catalytically active for the dehydrogenation of said paraffinic feed, and an acidic metal oxide component active in producing olefin cracking and hydroisomerization reactions at conditions sufficient to hydroisomerize and convert the feed to a mixture of isoparaffins which contains greater than 50 percent of mono-methyl species, with minimum formation of branches with substituent groups of carbon number greater than 1, based on the total weight of isoparaffins in the mixture, and recovering as the product of said reaction zone a high purity paraffinic solvent composition of carbon number ranging from about $C_8$ to about $C_{20}$ rich in isoparaffins which contain greater than 50 percent of said mono-methyl species, a molar ratio of isoparaffins:n-paraffins ranging from about 0.5:1 to about 9:1, and boils at a temperature ranging from about 320° F. to about 650° F.

2. The process of claim 1 wherein the feed is constituted predominantly of n-paraffins of carbon number ranging from about $C_{10}$ to about $C_{16}$, and the product high purity paraffinic solvent composition has carbon numbers ranging from about $C_{10}$ to about $C_{16}$.

3. The process of claim 1 wherein the feed is converted to a product high purity paraffinic solvent composition rich in isoparaffins which contains greater than 70 percent of the mono-methyl species.

4. The process of claim 1 wherein the high purity paraffinic solvent composition that is recovered has a molar ratio of isoparaffins:n-paraffins ranging from about 1:1 to about 4:1.

5. The process of claim 1 wherein the feed is converted to a product high purity paraffinic solvent composition rich in isoparaffins which contains greater than 70 percent of the mono-methyl species, and has a molar ratio of isoparaffins:n-paraffins ranging from about 1:1 to about 4:1.

6. The process of claim 1 wherein the product high purity paraffinic solvent composition boils at a temperature ranging from about 350° F. to about 550° F.

7. The process of claim 1 wherein the high purity solvent composition product is characterized as a mixture of paraffins of carbon number ranging from about $C_{10}$ to about $C_{16}$, has a molar ratio of isoparaffins:n-paraffins ranging from about 1:1 to about 4:1 and the isoparaffins of the mixture contain greater than 70 percent of the mono-methyl species, based on the weight of the mixture.

8. The process of claim 1 wherein the predominantly n-paraffin feed is a Fischer-Tropsch liquid.

9. The process of claim 1 wherein the catalyst is comprised of a Group VIII metal, or metals, supported on a particulate refractory inorganic oxide carrier.

10. The process of claim 9 wherein the catalyst is comprised of a Group IB or Group VIB metal, or metals, or both a Group IB and VIB metal, or metals, in addition to the Group VIII metal, or metals.

11. The process of claim 10 wherein the concentration of the metal, or metals, ranges from about 0.1 percent to about 20 percent, based on the total weight of the catalyst, the Group IB metal is copper, the Group VIB is molybdenum, and the Group VIII metal is palladium, platinum, nickel, or cobalt.

12. The process of claim 1 wherein the feed is hydroisomerized at temperature ranging between about 400° F. and about 800° F., at pressures ranging between about 100 psig and about 1500 psig, hydrogen treat gas rates ranging between about 1000 SCFB and about 10,000 SCFB, and at space velocities ranging between about 0.5 W/Hr/W to about 10 W/Hr/W.

13. The process of claim 12 wherein the feed is hydroisomerized at temperature ranging between about 550° F. and about 700° F., at pressures ranging between about 250 psig and about 1000 psig, hydrogen treat gas rates ranging between about 2000 SCFB and about 5000 SCFB, and at space velocities ranging between about 1.0 W/Hr/W and about 5.0 W/Hr/W.

14. The process of claim 1 wherein hydrogen consumption during the hydroisomerization reaction is negligible.

15. A process for the production of high purity paraffinic solvent compositions having superior low temperature properties and low viscosities which comprises contacting in a reaction zone a Fischer-Tropsch liquid feed constituted predominantly of n-paraffins of carbon number ranging from about $C_8$ to about $C_{20}$, with hydrogen, over a dual function catalyst comprised of a metal component catalytically active for the dehydrogenation of said paraffinic feed, and an acidic metal oxide component active in producing olefin cracking and hydroisomerization reactions at temperature ranging between about 400° F. and about 800° F., at pressures ranging between about 100 psig and about 1500 psig, hydrogen treat gas rates ranging between about 1000 SCFB and about 10,000 SCFB, and at space velocities ranging between about 0.5 W/Hr/W to about 10 W/Hr/W, to hydroisomerize and convert the feed to a mixture of isoparaffins which contains greater than 50 percent of mono-methyl species, with minimum formation of branches with substituent groups of carbon number greater than 1, based on the total weight of isoparaffins in the mixture, and recovering as a product of said reaction zone a high purity paraffinic solvent composition of carbon number ranging from about $C_8$ to about $C_{20}$ rich in isoparaffins which contain greater than 50 percent of said mono-methyl species, a molar ratio of isoparaffins:n-paraffins ranging from about 0.5:1 to about 9:1, and boils at a temperature ranging from about 320° F. to about 650° F.

16. The process of claim 15 wherein the feed is constituted predominantly of n-paraffins of carbon number ranging from about $C_{10}$ to about $C_{16}$, and the product high purity paraffinic solvent composition has carbon numbers ranging from about $C_{10}$ to about $C_{16}$.

17. The process of claim 15 wherein the feed is converted to a product high purity paraffinic solvent composition rich in isoparaffins which contains greater than 70 percent of the mono-methyl species.

18. The process of claim 15 wherein the high purity paraffinic solvent composition that is recovered has a molar ratio of isoparaffins:n-paraffins ranging from about 1:1 to about 4:1.

19. The process of claim 15 wherein the feed is converted to a product high purity paraffinic solvent composition rich in isoparaffins which contains greater than 70 percent of the mono-methyl species, and has a molar ratio of isoparaffins:n-paraffins ranging from about 1:1 to about 4:1.

* * * * *